United States Patent [19]

Carter et al.

[11] 4,220,520

[45] Sep. 2, 1980

[54] STARTUP METHOD FOR A REFORMING PROCESS

[75] Inventors: James L. Carter, Westfield; John H. Sinfelt, Berkeley Heights, both of N.J.

[73] Assignee: Exxon Research & Engineering Co., Florham Park, N.J.

[21] Appl. No.: 961,374

[22] Filed: Nov. 16, 1978

[51] Int. Cl.[2] ..... C10G 35/08

[52] U.S. Cl. ..... 208/139; 208/138

[58] Field of Search ..... 208/138, 139

[56] References Cited

U.S. PATENT DOCUMENTS

| | | | |
|---|---|---|---|
| 3,578,582 | 5/1971 | Jacobson | 208/138 |
| 3,936,369 | 2/1976 | Hayes | 208/139 |
| 3,939,060 | 2/1976 | Hayes | 208/139 |
| 3,953,368 | 4/1976 | Sinfelt | 252/466 PT |
| 3,956,107 | 5/1976 | Mitchell | 208/139 |
| 3,969,221 | 7/1976 | Mitchell et al. | 208/139 |
| 4,082,651 | 4/1978 | Antos | 208/139 |

*Primary Examiner*—C. Davis

*Attorney, Agent, or Firm*—Marthe L. Gibbons

[57] ABSTRACT

A startup method for a catalytic reforming process wherein the catalyst is maintained in a bed is provided in which a catalyst comprising an iridium component and at least one additional metal component such as a platinum group metal component is reduced, sulfided and contacted with hydrogen at specified conditions whereby the sulfur is distributed uniformly throughout the catalyst bed prior to contacting the catalyst with the hydrocarbon feed.

16 Claims, No Drawings

STARTUP METHOD FOR A REFORMING PROCESS

BACKGROUND OF THE INVENTION

1. Field of the Invention

This invention relates to a startup method for a reforming process utilizing an iridium and platinum group component reforming catalyst.

2. Description of the Prior Art

Reforming catalysts comprising an iridium component and a platinum group component composited with a suitable refractory support are well known.

U.S. Pat. No. 3,578,582 discloses sulfiding a reduced platinum-rhenium catalyst and subsequently contacting the sulfided catalyst with hydrogen prior to introducing the naphtha feed into contact with the catalyst.

Sulfiding a reduced tri-metallic reforming catalyst to incorporate low levels of sulfur on the catalyst is also known. See, for example, U.S. Pat. No. 3,936,369 wherein the catalyst comprises iridium, germanium, and platinum or palladium and 0.05 to 0.5 weight percent sulfur; U.S. Pat. No. 3,939,060 wherein the catalyst comprises iridium, nickel, platinum or palladium and 0.01 to 1 weight percent sulfur; and U.S. Pat. No. 4,082,651 wherein the catalyst comprises rhodium, rhenium and platinum or palladium and 0.01 to about 1 weight percent sulfur.

Polymetallic cluster catalysts, including bimetallic cluster catalysts, comprising an iridium component and a platinum group metal component are also known. See U.S. Pat. No. 3,953,368, the teachings of which are hereby incorporated by specific reference.

It has now been found that a startup method for an iridium and platinum group metal-containing reforming catalyst at specified conditions will provide advantages that will become apparent in the ensuing description.

SUMMARY OF THE INVENTION

In accordance with the invention there is provided, in a startup method for a reforming process wherein a substantially sulfur-free hydrocarbonaceous feed is contacted under reforming conditions in the presence of hydrogen with a bed of a fresh or regenerated catalyst comprising metal components and a refractory support, said metal components being selected from the group consisting of an iridium component and at least one additional metal component selected from the group consisting of ruthenium, rhodium, palladium, osmium, platinum, copper, silver and gold, said fresh or regenerated catalyst having been reduced by contact with a reducing agent, the improvement which comprises the steps of: (a) contacting the reduced catalyst with a sulfiding agent in a sulfiding zone such as to provide from about 0.3 to about 2.0 atoms of sulfur per atom of said metal components and subsequently (b) contacting the resulting sulfided catalyst with a hydrogen-containing gas at a temperature ranging from about 900° to about 950° F. to remove excess sulfiding agent from said sulfiding zone and to distribute said sulfur uniformly throughout said bed prior to contacting said sulfided catalyst with said hydrocarbonaceous feed.

DETAILED DESCRIPTION OF THE INVENTION

The startup method of the present invention is suitable for use at the beginning of a reforming process utilizing a fresh or a regenerated reforming catalyst comprising an iridium component and at least one additional metal component.

The startup method of the present invention is particularly suited to startup a naphtha hydroforming (reforming) process utilizing a substantially sulfur-free naphtha feed that typically contains about 20 to about 80 volume percent paraffins, 20 to 80 volume percent naphthenes, and about 5 to about 20 percent aromatics, and boiling at atmospheric pressure substantially between about 80° and 450° F., preferably between 150° and 375° F. By "substantially sulfur-free" is intended herein that the feed contains less than about 25 wppm sulfur, preferably less than 10 wppm sulfur. A suitable feed, as given above, is brought into contact with the pretreated reforming catalyst of the present invention in the presence of hydrogen under conventional reforming conditions. The reactions typically take place in the vapor phase at a temperature ranging from about 650° to about 1000° F., preferably from about 750° to about 980° F. Reaction zone pressures may vary from about 1 to about 50 atmospheres, preferably from about 5 to about 25 atmospheres.

A naphtha feed stream is generally passed over the catalyst at space velocities ranging from 0.5 to 20 parts by weight of naphtha per hour per part by weight of catalyst (W/Hr/W), preferably from about 1 to 10 W/Hr/W. The hydrogen to hydrocarbon mole ratio within the reaction zone is maintained between about 0.5 and 20, preferably between 1 and 10. During the reforming process, the hydrogen employed can be in admixture with light gaseous hydrocarbons. Since the hydroforming process produces hydrogen, a recycle stream is employed for admission of hydrogen with the feed. In a typical operation, the catalyst is maintained as a fixed bed within a series of adiabatically operated reactors. Specifically, the product stream from each reactor, except the last, in the reactor series is reheated prior to passage to the following reactor. As an alternate to the above-described process sequence, the catalyst may be employed in a moving bed in which the naphtha feed, hydrogen and catalyst are passed in parallel to the reactor, or in a fluidized system wherein the naphtha feed is passed upwardly through a turbulent bed of finely divided catalyst. The catalysts which find use in the method of the present invention comprise a support and metal components consisting of iridium and at least one additional metal component selected from the group consisting of platinum group metals, copper, silver and gold. Preferably, the catalytic metal components consist of iridium and one additional metal component selected from the group consisting of platinum group metals, copper, silver and gold. Most preferably, the catalytic metal components consist of iridium and one additional metal component selected from the group consisting of ruthenium, rhodium, palladium, osmium and platinum. Generally, the iridium component is present in the catalyst in an amount ranging from about 0.01 to 3 weight percent and the additional metal component is present in an amount ranging from about 0.01 to about 3 weight percent, said weights being calculated as if the iridium component and the additional metal component were present in the elemental metallic state, based on the total weight of the dry catalyst. The term "platinum group" is used herein to refer to all the noble metals of Group VIII of the Periodic Table of Elements as well as compounds and mixtures thereof. Platinum is preferred as the platinum group component.

The support or carrier component of the catalyst used in the present invention is preferably a porous adsorbent material having a surface area, as determined by the Brunauer-Emmett-Teller (BET) method, of from about 20 to about 800, preferably from about 100 to about 300 square meters per gram. The support material should be substantially refractory at temperature and pressure conditions utilized in the reforming process. Typical porous inorganic oxide supports are the naturally occurring aluminosilicates, naturally occurring or synthetically prepared alumina, magnesia, silica-alumina, silica-zirconia, silica-alumina-zirconia, silica-alumina-magnesia and crystalline aluminosilicate zeolites. The preferred catalyst supports are alumina and silica-alumina. The particularly preferred catalytic support is alumina. Any of the forms of alumina suitable as supports for reforming catalysts can be used. The catalyst may be promoted for reforming by the addition of halides, particularly fluorides or chlorides. The halogen in the catalyst may be present in an amount ranging from about 0.1 to about 3 weight percent, based on the total weight of the catalyst. The halogen may be incorporated into the catalyst at any suitable stage in the catalyst manufacture, i.e., before, during, or after incorporation of the catalytic metals onto the support material. Halogen may also be incorporated by contacting the catalyst with a gaseous stream containing the halogens, generally chlorine.

A preferred catalyst for use in the present invention is a bimetallic cluster catalyst having clusters of an average size of less than about 50 Angstroms, such as the catalysts described in U.S. Pat. No. 3,953,368, the teachings of which are incorporated by reference. The preferred catalyst comprises metal components and a refractory support. The metal components consist essentially of an iridium component and at least an additional metal component selected from the group consisting of ruthenium, rhodium, palladium, osmium, platinum, copper, silver and gold. More preferably, the catalyst comprises a refractory support and an iridium component and a platinum component. The iridium component may suitably be present in an amount of about 0.01 to 3 weight percent, preferably from 0.1 to 1 weight percent, calculated as the metal, based on the total dry catalyst. The platinum component may suitably be present in an amount ranging from about 0.01 to 3 weight percent, preferably 0.1 to about 1, more preferably 0.15 to 0.5 weight percent, calculated as the metal, based on the total dry catalyst. Additionally, a halogen component may be present in the catalyst, suitably in amounts of about 0.1 to 3 weight percent, based on the total catalyst. In the preparation of the preferred cluster catalyst, as taught in U.S. Pat. No. 3,953,368, following the impregnation of the support with the metal components, the catalyst is dried at temperatures varying from 220° to 250° F. The catalyst may simply be dried in air at the above-stated temperature or may be dried by treating the catalyst in a flowing stream of inert gas or hydrogen. The drying step may be followed by an additional calcination step at a temperature of about 500° to 700° F. Care must be taken to avoid contacting the catalyst at temperatures in excess of 700° to 850° F. with air or other gas of high oxygen concentration. Otherwise, large iridium oxide crystallites will be formed and the desired metallic clusters will not be obtained on reduction. The catalyst is typically reduced at a temperature of 500° to 1000° F. or higher with a hydrogen-containing gas prior to use, for example, for a period of at least 0.1 hours.

In accordance with the present invention, the reduced catalyst is contacted with a sulfiding agent for a time sufficient to provide from about 0.3 to about 2.0 atoms of sulfur per atom of said metal components, preferably from about 0.1 to about 0.5 atoms of sulfur per atom of said metal components, that is, of the iridium plus at least one of said metal components.

Contact of the catalyst with the sulfiding agent is suitably conducted at elevated temperatures and pressures, suitably at a temperature ranging from about 75° to about 1000° F. and at a pressure ranging from about 20 to about 500 psig, with conventional sulfiding agents such as hydrogen sulfide, precursors of hydrogen sulfide, carbon disulfide, mercaptans, as is well known in the art. The sulfiding step is generally conducted in the presence of hydrogen. After the catalyst has been sulfided for a time sufficient to provide the desired low level of sulfur on the catalyst, the sulfided catalyst is contacted with a hydrogen-containing gas at a temperature ranging from about 900° to about 950° F., preferably at a temperature of at least 925° F. and a pressure of about 20 to about 500 psig for a time sufficient to provide uniform distribution of the sulfur throughout the catalyst bed and to remove the excess sulfiding agent from the sulfiding zone, for example for a period of at least about 0.5 hour, suitably for a time ranging from about 0.5 to about 24 hours. The hydrogen utilized may be pure hydrogen but will generally be a hydrogen stream containing some other gaseous components, for example, the hydrogen-containing effluent gas produced in the reforming process.

The resulting catalyst is subsequently contacted with the hydrocarbonaceous feed at reforming conditions.

EXAMPLE 1

An experimental reforming run was performed utilizing a platinum-iridium-alumina catalyst comprising 0.3 weight percent platinum and 0.3 weight percent iridium. The hydrocarbonaceous feed used was a mixed naphtha which had an API gravity of 54.5 at 60° F., about 46 volume percent paraffins, about 43 volume percent naphthenes and the balance aromatics.

The startup procedure used was a prior art procedure. The catalyst was sulfided at 700° F. in a gaseous mixture comprising hydrogen and hydrogen sulfide. The resulting catalyst comprised 0.1 weight percent sulfur, or expressed in terms of atomic ratio, 0.93 atom sulfur per atom of metal, after the treat. The conditions utilized during the experimental run were 200 psig, 900° F. average catalyst temperature, a hydrogen-rich gas recycle rate of 6000 SCF/B. The hydrocarbonaceous feed rate was adjusted to obtain a product with a Research Octane number of 100.

EXAMPLE 2

Another experimental run was performed utilizing a platinum-iridium-alumina catalyst comprising about 0.3 weight percent platinum and 0.3 weight percent iridium.

The hydrocarbonaceous feed used was a naphtha having the same proportions of constituents and gravity as the feed used in Example 1.

The catalyst was pretreated in accordance with the startup procedure of the present invention as follows: the catalyst was sulfided at 700° F. in a gaseous mixture comprising hydrogen and hydrogen sulfide. Subsequently, the catalyst was heated in a hydrogen stream at 950° F. until there were less than 2 volume ppm of the $H_2S$ in the reactor effluent gas. This treatment left 0.029 wt. % sulfur, or expressed another way, 0.27 sulfur atom per metal atom, on the catalyst.

The test conditions were 200 psig, 900° F. average catalyst temperature, a hydrogen-rich gas recycle rate of 6000 SCF/B. The hydrocarbonaceous feed rate was adjusted to obtain a product with a Research Octane Number of 100. Results of the comparative experiments of Example 1 and Example 2 are summarized in Table I.

TABLE I

| | Relative Catalyst Activity | |
|---|---|---|
| Hours on Feed | Example 1 | Example 2 |
| 200 | 98 | 112 |
| 400 | 82 | 100 |
| 600 | 75 | 100 |

As can be seen from Table I, Example 2, which used the startup method of the present invention, resulted in improved catalyst activity and activity maintenance.

EXAMPLE 3

In this test, a platinum-iridium-alumina catalyst comprising about 0.3 wt. % platinum and 0.3 wt. % iridium was sulfided according to a prior art method, in a gaseous mixture comprising hydrogen and hydrogen sulfide at 700° F. Subsequently, the catalyst was removed from the reactor and the sulfur level on the catalyst was measured at various points in the catalyst bed to determine the uniformity of the sulfur distribution. The bed was divided into three equal parts and it was found that the inlet third of the catalyst comprised 0.092 wt. % sulfur, the middle third comprised 0.054 wt. % sulfur and the outlet third comprised 0.048 wt. % sulfur. Thus, the sulfur was not uniformly distributed and the average sulfur content for the catalyst bed was 0.065 wt. %, or expressed another way, it was 0.6 atom sulfur per atom of metal.

EXAMPLE 4

In this test a platinum-iridium-alumina catalyst comprising about 0.3 wt. % platinum and 0.3 wt. % iridium was sulfided in accordance with the method of the present invention, in a gaseous mixture comprising hydrogen and hydrogen sulfide at about 950° F., then heated in a hydrogen stream until there were less than 2 vol. ppm of $H_2S$ in the reactor effluent gas. Subsequently, the catalyst was removed from the reactor and the sulfur level on the catalyst was measured at various points in the catalyst bed to determine the distribution of the sulfur. The catalyst bed was divided into three equal parts and it was found that the inlet third of the catalyst comprised 0.033 wt. % sulfur, the middle third comprised 0.04 wt. % sulfur and the outlet third comprised 0.037 wt. % sulfur. Thus, the sulfur on the catalyst bed was found to be evenly distributed with the test run of Example 4 which was performed using the startup method of the present invention. Furthermore, the average sulfur for the entire bed was 0.037 wt. % or, expressed another way, it was 0.34 atom of sulfur per metal atom of the catalyst. Moreover, the sulfur content of the catalyst of Example 4 was lower than the sulfur content of the catalyst of Example 3, which was the comparative prior art run.

EXAMPLE 5

A platinum-iridium-alumina catalyst comprising 0.3 wt. % platinum and 0.3 wt. % iridium was sulfided in a gaseous mixture comprising hydrogen and hydrogen sulfide at 700° F. for a time sufficient to deposit 0.07 wt. % sulfur on the catalyst. The catalyst was then heated in a hydrogen stream and the hydrogen sulfide concentration in the reactor effluent gas was monitored continuously. There was no detectable hydrogen sulfide in the effluent gas until the temperature exceeded the temperature of 850° F. and there was no significant detectable hydrogen sulfide in the effluent gas until the temperature reached 900° F. The results of this test are summarized in Table II.

TABLE II

| Catalyst Temperature | Vol. PPM $H_2S$ in Effluent Gas |
|---|---|
| 700° F. | 0 |
| 750° F. | 0 |
| 800° F. | 0 |
| 850° F. | 0.3 |
| 900° F. | 1.7 |
| 950° F. | 4.4 |

The data of Table II show that a critical temperature range is required to remove the excess sulfur from the catalyst, said range being from about 900° F. to about 950° F.

What is claimed is:

1. In a start-up method for a reforming process wherein a substantially sulfur-free hydrocarbonaceous feed is contacted under reforming conditions in the presence of hydrogen with a bed of a fresh or regenerated catalyst comprising metal components and a refractory support, said metal components being selected from the group consisting of an iridium component and at least one additional metal component selected from the group consisting of ruthenium, rhodium, palladium, osmium, platinum, copper, silver and gold, said metal components being present as clusters having an average size not greater than about 50 Angstroms, said fresh or regenerated catalyst having been reduced by contact with a reducing agent, the improvement which comprises the steps of:

(a) contacting the reduced catalyst with a sulfiding agent in a sulfiding zone such as to provide from about 0.3 to about 2.0 atoms of sulfur per atom of said metal components and, subsequently (b) contacting the resulting sulfided catalyst with a hydrogen-containing gas at a temperature ranging from about 900° to about 950° F. for a time sufficient to remove the excess sulfiding agent from said sulfiding zone and to distribute said sulfur uniformly throughout said bed prior to contacting said sulfided catalyst with said hydrocarbonaceous feed.

2. The method of claim 1 wherein said reduced catalyst is contacted with said sulfiding agent such as to provide from about 0.1 to about 0.5 atom of sulfur per atom of said metal components.

3. The method of claim 1 wherein said reduced catalyst is contacted with said sulfiding agent in said sulfiding zone of step (a) in the presence of hydrogen.

4. The method of claim 1 wherein said catalyst is contacted with an oxidizing gas at a temperature not greater than about 700° F. prior to said reduction step.

5. The method of claim 1 wherein said sulfiding agent comprises hydrogen sulfide.

6. The method of claim 1 wherein said sulfided catalyst is contacted with said hydrogen-containing gas for a period of time of at least about 0.5 hour.

7. The method of claim 1 wherein said sulfided catalyst is contacted with said hydrogen-containing gas at a temperature of at least about 925° F.

8. The method of claim 1 wherein said catalyst is contacted with said reducing agent at a temperature ranging from about 500° to about 700° F. for a time sufficient to reduce said metal components substantially to the corresponding elemental metals.

9. The method of claim 1 wherein said catalyst is contacted with said reducing agent for at least about 0.1 hour.

10. The method of claim 1 wherein said catalyst comprises a halogen component.

11. The method of claim 1 wherein said refractory support is an inorganic oxide.

12. The method of claim 1 wherein said refractory support comprises alumina.

13. The method of claim 1 wherein said metallic components consist essentially of an iridium component and an additional metal component selected from the group consisting of ruthenium, rhodium, palladium, osmium, platinum, copper, silver and gold.

14. The method of claim 1 wherein said metal components consist essentially of an iridium component and a platinum component.

15. The method of claim 1 wherein said catalyst comprises bimetallic clusters consisting essentially of iridium and platinum dispersed on an inorganic oxide support, said clusters having an average size not greater than about 50 Angstroms, said iridium being present in the total catalyst in an amount greater than about 0.1 weight percent and said platinum being present in the total catalyst in an amount ranging from about 0.1 to about 1 weight percent.

16. The method of claim 1 wherein said catalyst additionally comprises a halogen component in an amount ranging from about 0.1 to about 3 weight percent, based on the total catalyst.

* * * * *